US008359696B1

(12) United States Patent
Turner et al.

(10) Patent No.: US 8,359,696 B1
(45) Date of Patent: Jan. 29, 2013

(54) SEPARABLE DRAIN SNAKE DEVICE AND KIT

(76) Inventors: Stephen S. Turner, Edelstein, IL (US); Scott I. Turner, Chillicothe, IL (US)

( * ) Notice: Subject to any disclaimer, the term of this patent is extended or adjusted under 35 U.S.C. 154(b) by 0 days.

(21) Appl. No.: 13/401,669

(22) Filed: Feb. 21, 2012

(51) Int. Cl.
*B08B 9/02* (2006.01)

(52) U.S. Cl. ..... 15/104.33; 15/104.03

(58) Field of Classification Search ..... 15/104.33, 15/104.16, 257.01, 104.001, 104.03, 104.02
See application file for complete search history.

(56) References Cited

U.S. PATENT DOCUMENTS

| | | | | |
|---|---|---|---|---|
| 566,110 | A | 8/1896 | Wrigley | |
| 984,473 | A | 2/1911 | Cornelius | |
| 1,783,256 | A | 12/1930 | Miller | |
| 2,880,435 | A | 4/1959 | Deustch et al. | |
| 4,154,545 | A | 5/1979 | Pinto et al. | |
| 4,642,931 | A | 2/1987 | Flores | |
| 4,679,961 | A | 7/1987 | Stewart | |
| 4,887,929 | A | 12/1989 | Hale | |
| 5,018,918 | A | 5/1991 | Jacobs et al. | |
| 6,898,807 | B2 * | 5/2005 | Tash | 4/255.01 |
| 2001/0042277 | A1 | 11/2001 | Reichborn | |
| 2003/0231927 | A1 | 12/2003 | Hale | |
| 2006/0195994 | A1 * | 9/2006 | Hung | 15/104.095 |

FOREIGN PATENT DOCUMENTS

| | | | |
|---|---|---|---|
| GB | 1556262 | A1 | 11/1979 |

* cited by examiner

*Primary Examiner* — Robert Scruggs
(74) *Attorney, Agent, or Firm* — C. C. Shroff

(57) ABSTRACT

A drain snake device having a rotatable handle crank at one end and an interlocking opposite end. The interlocking end is uniquely attachable to a corresponding attachment end portion of a disposable elongated snake segment. A slidable sleeve, that moves axially along the distal end of the handle between a locking position and a release position, fully engages or releases the disposable snake segment, respectively, and also simultaneously allows or blocks rotation of the handle crank, respectively. A kit containing a reusable handle and two or more uniquely corresponding snake segments is also provided.

3 Claims, 4 Drawing Sheets

SEPARABLE DRAIN SNAKE DEVICE AND KIT

BACKGROUND OF THE INVENTION

Drain snakes have been available and used to clear obstacles from drain pipes and related piping systems for many years. At one end is a handle crank or other type of holding and turning object. At the other end is an attachment that is capable of grabbing or removing obstructing debris from a drain pipe, such as hair or other material.

U.S. Pat. No. 566,110 issued to Wrigley on Aug. 18, 1896, shows a cleaning device including a rotatable handle (item f in FIGS. 1-2) at one end and any of various attachments at the other end, FIGS. 4-8. This document appears to be silent regarding a detachable snake portion interlocking with a handle portion. Similarly, see U.S. Pat. No. 984,473 issued to Cornelius on Feb. 14, 1911.

U.S. Pat. No. 1,783,256 issued to Miller on Dec. 2, 1930 shows a device for cleaning out drain pipes including a detachable handle (item 14 in FIG. 1). However, this handle lacks any interlocking structure as provided in the present invention, which selectively interlocks between a reusable handle and a disposable snake segment.

U.S. Pat. No. 5,018,918 issued to Jacobs et al. on May 28, 1991 shows a cargo vehicle load restraint bar having an axially movable sleeve that slides onto a toggle joint to lock the joint into a straight condition (see Abstract and item 62 in the Front Page Figure). However, this structure lacks an interlocking feature between the two straight tubular portions, and is unrelated to a drain pipe cleaning device.

U.S. Pat. No. 4,154,545 issued to Pinto et al. on May 15, 1979 shows an externally mounted locking mechanism for telescoping tubes that permits releasable adjustment of the tubes, see the Front Page Figure. FIG. 1 shows the use of the locking mechanism in a paint roller handle (see item 10). However, this mechanism has no interlocking structure including the locking sleeve feature that is provided in the present invention, particularly in a drain snake device.

U.S. Pat. No. 4,679,961 issued to Stewart on Jul. 14, 1987 shows a coupling mechanism in which a male and a female coupling fixture are mated and a sleeve slides coaxially into a locked position over the joint to keep the joint in a straight orientation (see item 31 in the Front Page Figure). However, this interlocking structure allows the tubular portions 30 and 33 to rotate coaxially independently with respect to each other. By contrast, the present invention requires that the snake segment be firmly rotatable only by turning the handle crank, i.e., the snake segment cannot be free to rotate independently from the handle during use.

There are several drain snake devices and generally similar structures disclosed in the prior art in which two elongated parts are generally interlocked at their ends, and which may involve an axially movable sleeve to hold them together. U.S. Pat. No. 4,642,931 issued to Flores on Feb. 17, 1987 shows a compact foldable fishing pole in which the pole segments are locked into a coaxial arrangement where the ends meet, using a movable sleeve, see items 26 and 28 in FIGS. 1-2. However, this structure fails to provide a handle crank to rotate the elongated distal portion, e.g., for use in cleaning debris from drain pipes.

U.S. Pat. No. 2,880,435 issued to Deutsch et al. on Apr. 7, 1959, shows a pipe cleaning apparatus including two elongated segments that are interlocked at their ends, see FIG. 6. However, this structure lacks an axially movable sleeve to hold the segments together.

GB1556262 filed by Elversson, published Nov. 21, 1979 shows a tool for progressing a flexible leading wire through a hollow passage for drawing an electrical cable through a hidden conduit including a sleeve (items 14/15 in FIGS. 4-5) and a locking body (item 6 in FIGS. 4-5) that holds the sleeve in position. However, this arrangement lacks a continuously rotatable handle crank for removing obsructing debris from a pipe or conduit, and a sleeve having a proximal notch to hold the handle in a nonrotating orientation as provided in this invention to permit engaging or disengaging the handle from the remainder of the device.

U.S. Published Patent Application No. 2003/0231927 published by Hale on Dec. 18, 2003 shows a connector for a pipe cleaning apparatus including an interlocking feature between two elongated sections of the device, and using a sleeve to hold the interlocked ends together, as shown in FIG. 2. However, this structure fails to provide the sleeve notch to hold the handle in a non-rotating orientation while the snake portion and handle portion are interlocked or released, as described in the present specification. Similarly, see U.S. Pat. No. 4,887,929 issued to Hale on Dec. 19, 1989, particularly FIGS. 5-6.

U.S. Published Patent Application No. 2001/0042277 published by Reichborn on Nov. 22, 2001 shows a quick disconnect tube cleaning brush coupling, including a spring-loaded sleeve that holds together two interlocking ends of elongated sections of a pipe cleaning structure, see item 16 of the Front Page Figure. However, this arrangement lacks any simultaneous feature in the sleeve to block the rotation of the handle while the interlocked ends are mated together or are disconnected from each other.

Therefore, there is a need for a drain snake structure that has the capability of removing a reusable handle from a disposable snake segment, in which the handle interlocks with the snake segment during use, and can be detached for disposal of the snake segment.

Also, there is a further need to provide a drain snake structure in which the handle is directly interlocked with a snake portion and in which the handle is held in a non-rotating or temporarily fixed arrangement while the snake segment is detached from or attached to the handle. This temporarily fixed handle arrangement allows a disposable snake segment to be easily attached to or removed from a corresponding reusable handle. This feature is accomplished by the use of an axially movable sleeve having a notch at its proximal end, as described further in the detailed description.

Furthermore, there is a need for a drain snake kit containing a reusable handle and two or more disposable snake segments that are matched to uniquely interlock with the reusable handle.

BRIEF SUMMARY OF THE INVENTION AND OBJECTIVES

The objective of the invention is to provide a drain snake device having a disposable snake segment and a reusable handle, in which the handle is attachable to the snake segment in an interlocking manner and is easily detached therefrom using a slidable sleeve movable on the handle.

It is a further objective to provide the drain snake device with a sleeve movable on a distal portion of the handle that can be moved coaxially on the distal portion of the handle between a locked position, in which the corresponding ends of the handle and snake segments are engaged and interlocked and in which the device is then capable of routine use, and a release position, in which the handle is blocked from rotation and the snake segment can be easily engaged with or disengaged from the handle.

It is yet a further objective to provide a kit containing a reusable handle and two or more disposable snake segments that are matched in their interlocking end portions to the corresponding interlocking end portion of the handle.

DETAILED DESCRIPTION

Figure 1:
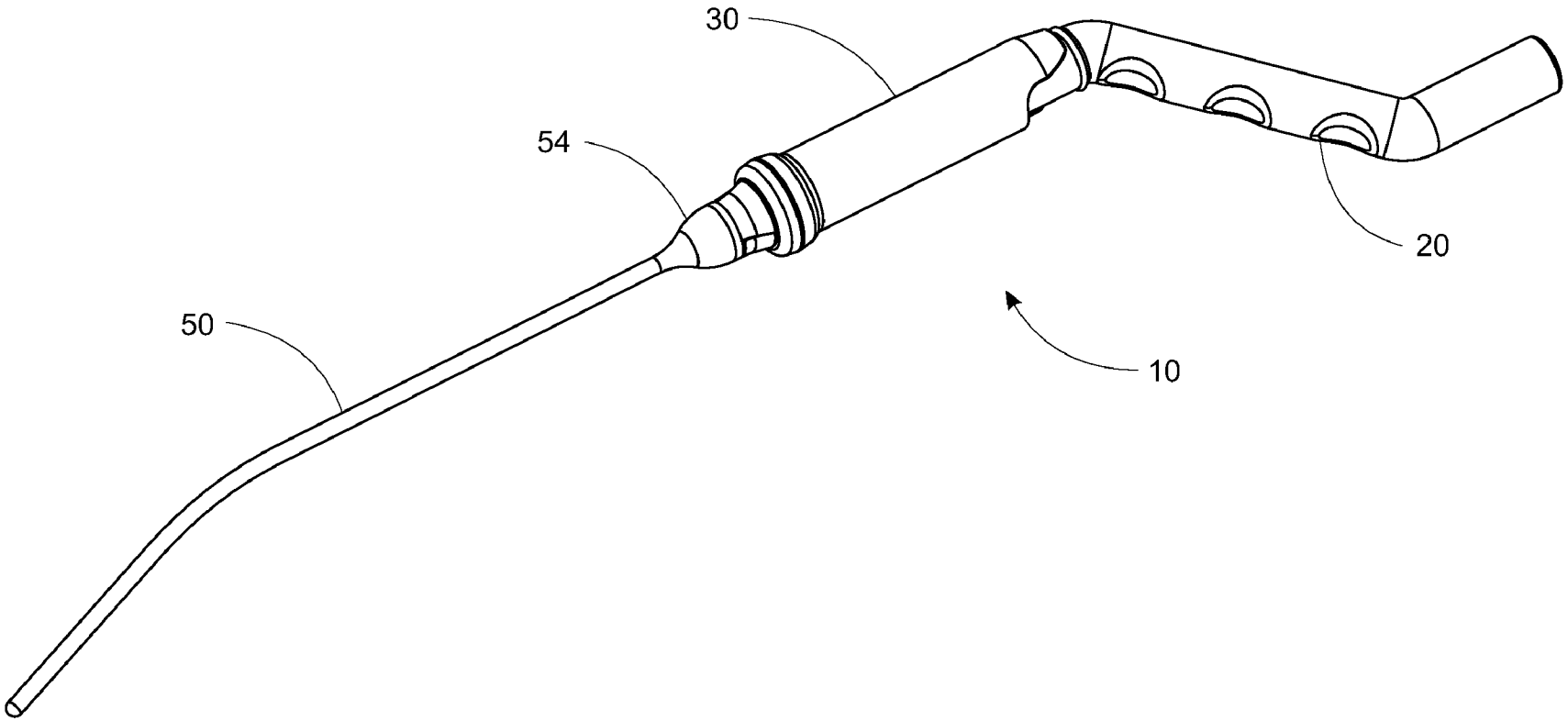
FIG. 1 shows a perspective view of the inventive drain snake device with the disposable snake portion in the fully engaged configuration (i.e., with the handle sleeve in the LOCKED POSITION and the handle free to be rotated).

FIG. 1 shows a perspective view of the inventive drain snake device 10 including a reusable handle portion 20 and a disposable snake segment 50. The disposable snake segment 50 is attached to the handle portion 20 by engagement of the proximal end 54 (i.e., the end that is closest to the person when operating the device) of the drain snake segment fully engaged with the distal end of the handle portion 20. A slidable sleeve 30 is shown in the LOCKED POSITION and the drain snake device 10, as shown in FIG. 1, is in the fully engaged configuration. The sleeve 30 in this LOCKED POSITION ensures that the snake segment and handle portion are fully engaged, i.e., interlocked at their corresponding ends, and the device is ready for use, such as for clearing a clogged drain pipe or for other similar pipe-cleaning or duct-cleaning functions.

Figure 2:
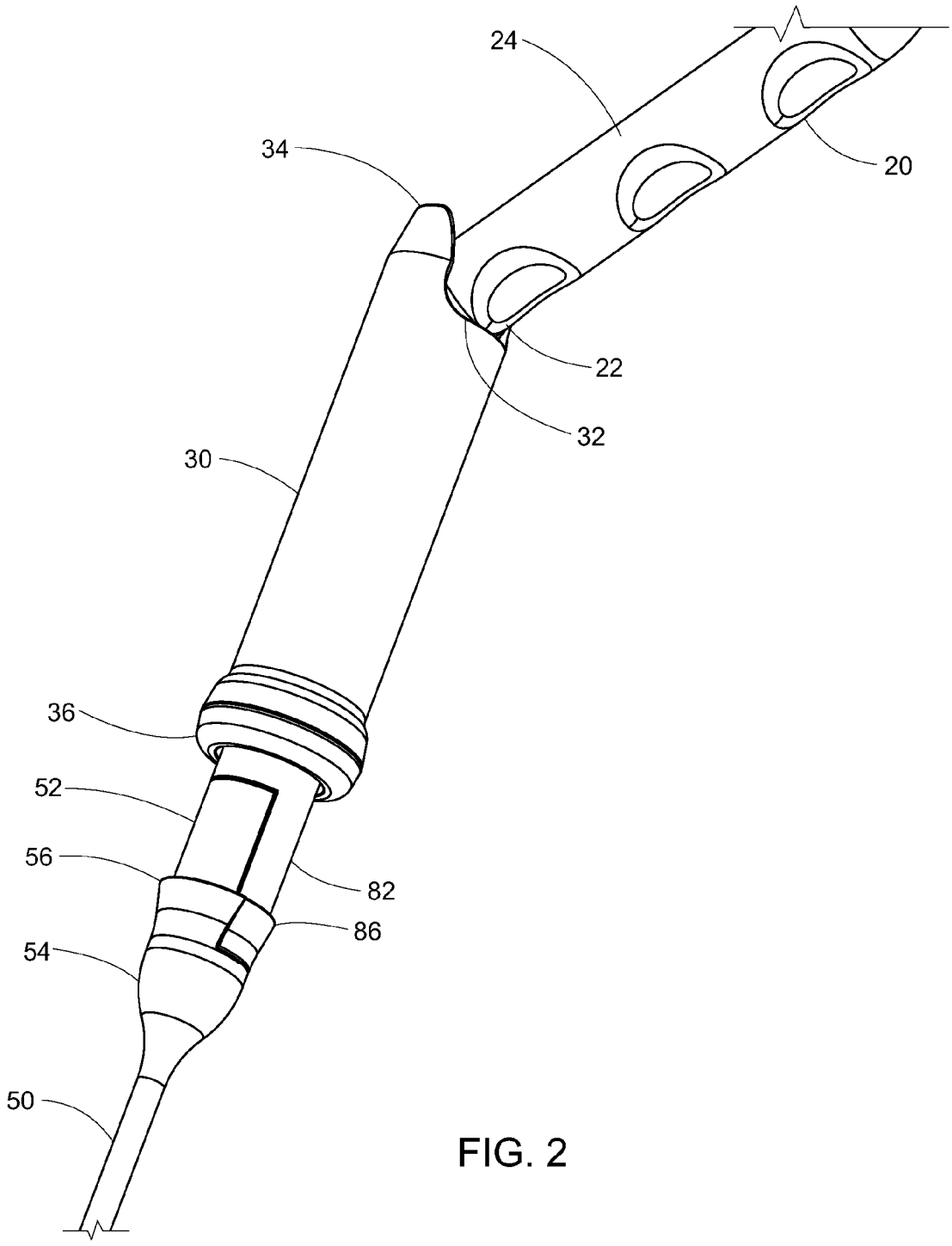
FIG. 2 shows a close-up perspective view of the distal end of the handle of the inventive drain snake device with the disposable snake portion attached to the handle, but with the sleeve in the RELEASE POSITION.

The handle 20 is made up of three integrally attached sections: 1) a proximal section or "handle crank" that is gripped to rotate the handle and snake segments during use (28, FIG. 4); 2) an intermediate section attached at its proximal end to and arranged at an oblique angle with the proximal section (24, FIGS. 2 & 4); and 3) a distal section (shown partially extending from the proximal end of sleeve 30 in FIG. 1 and from the distal end of sleeve 30 in FIG. 2, item 82) that extends from the intermediate section at an oblique angle and which attaches at its distal end to the proximal end of the snake segment 50 in an interlocking manner. The proximal section (28) and intermediate section (24) each have a hand grip that together act as a crank when the handle is rotated. The intermediate handle section attaches to the distal section at an oblique bend 22 shown in FIGS. 2 and 4.

Figure 3:
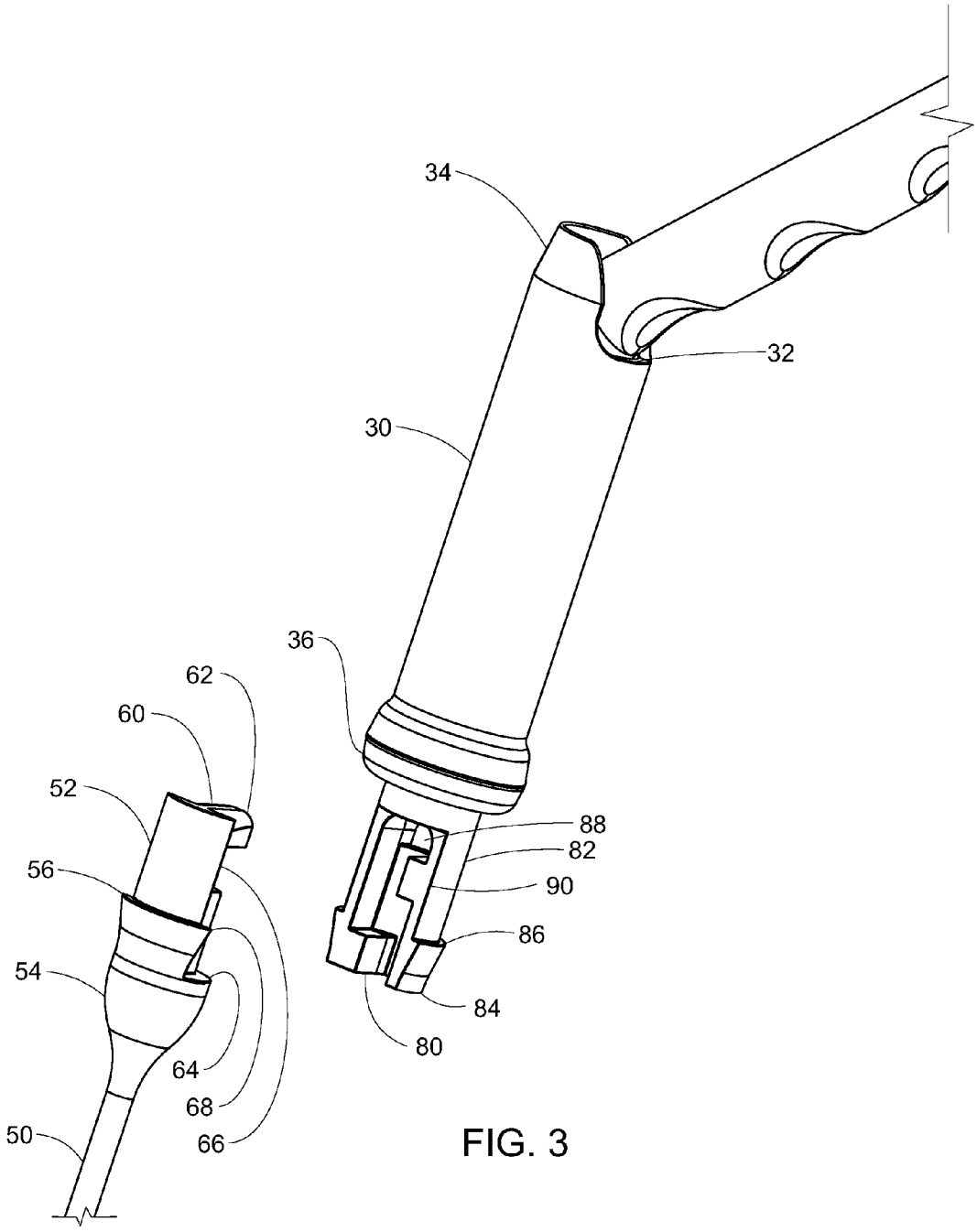
FIG. 3 shows a close-up perspective view of the distal end of the handle of the inventive drain snake device with the disposable snake segment detached from the handle, and with the handle sleeve in the RELEASE POSITION.
Figure 4:
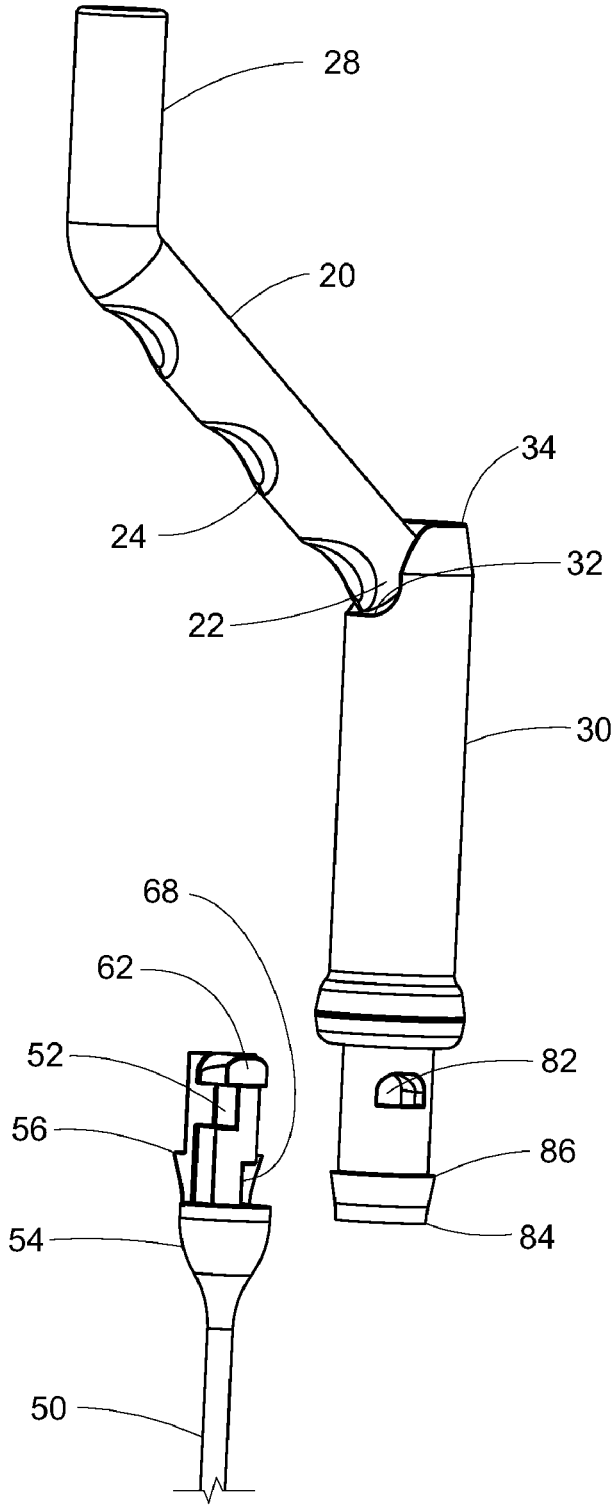
FIG. 4 shows a perspective view of the entire inventive drain snake device with the snake segment detached from the handle and the handle sleeve in the RELEASE POSITION.

The sleeve 30 can be moved back and forth between two possible positions along the distal end of the handle portion 20 of the device 10: a LOCKED POSITION (as shown in FIG. 1) and a RELEASE POSITION (shown in FIGS. 2-4).

When the drain snake device is in the fully engaged configuration as shown in FIG. 1, the drain snake device is ready for use. The distal end of the snake segment 50 can be inserted into a clogged drain or other similarly obstructed pipe. The user then places one hand on the sleeve 30 and uses the other hand to rotate (or crank) the handle crank 22, which causes the snake segment 50 to rotate simultaneously with handle, inside the clogged drain or obstructed pipe, thereby removing obstructing materials. The handle crank 22 can be turned indefinitely to rotate the snake segment, thereby continuously collecting debris at the distal end of the snake segment.

The distal end of the snake segment can be equipped with a hair-catching structure that collects hair material or debris clogging a drain. Other optional structures can be fitted onto the distal end of the snake segment to collect other types of clogging debris or obstructions. These types of distal end-attachments are considered well known in the art.

After use, the snake segment is disengaged from the handle portion (as described below) and can be discarded in an appropriate disposal receptacle, or in an appropriate recycling collection container.

FIG. 2 shows the drain snake device in a non-engaged configuration with the sleeve 30 moved rearward into the RELEASE POSITION. In FIG. 2, the proximal end of the snake segment as shown, remains attached to the distal end of the handle portion, but is free to be detached.

The sleeve 30 has a generally cylindrical shape, but particularly includes a notch 32 at its proximal end 34. When the sleeve is moved backward to its RELEASE POSITION, the handle must be rotated into the arrangement shown in FIG. 2, so that the bend portion 22 of the handle fits into the notch 32 of the sleeve 30, thereby blocking further rotation of the handle. Once the sleeve is moved back in this position, the interlocking ends of the snake segment and handle portion are exposed as shown and can be detached.

The interlocking region at the proximal end of the snake segment includes a partial annular shoulder stop 56 and a partial cylindrical end 52 that match a respective partial annular shoulder stop 86 and partial cylindrical portion 82 at the distal end of the handle 20 (FIG. 2). When the sleeve 30 is moved to the RELEASE POSITION as shown, the two corresponding partial cylindrical portions 52 and 82, are exposed and can be decoupled or detached. Alternatively, when the sleeve 30 is moved to the LOCKED POSITION (FIG. 1), the distal end 36 of the sleeve 30 is moved axially forward until it rests against the two partial annular shoulder stops, 56 and 86. When a snake segment is engaged, i.e., its proximal end is interlocked with the distal end of the handle 20, the sleeve 30 can be moved to its LOCKED POSITION and the snake drain device is ready for use and can be properly operated.

The interlocking region of the snake segment and the handle portion is shown in more detail in FIG. 3.

When sleeve 30 is moved to its RELEASE POSITION, the snake segment can be disengaged from the distal end 82 of the handle 20, as shown in FIG. 3. In this position, the sleeve notch 32 rests against the bend neck of handle 20, thereby preventing the handle from further rotatation relative to the sleeve 30. Moreover, in this RELEASE POSITION, the generally cylindrical distal end 82 of the handle is clearly exposed.

When interlocked with the corresponding end of the snake segment, the partial cylinder 52 of the snake segment combines with the partial cylinder 82 of the handle to form a generally cylindrical interlocked structure that fits inside the bore of the sleeve 30; and this interlocked structure can rotate inside the sleeve 30 (e.g., during routine operation) when the sleeve is moved to the LOCKED POSITION.

In addition, in the embodiment shown in FIGS. 2-3, when the snake segment is interlocked with the handle (as shown in FIG. 2), projection 62 (FIG. 3) of the snake segment fits in the corresponding opening 88, and axial stop 64 and surfaces 66 and 68 of the proximal end of the snake segment fit in the corresponding stop 84 and surfaces 80 and 90 at the distal end of handle 20, as shown.

A further shaped axial stop surface 60 is provided at the end of the snake segment 50, as shown, which matches a correspondingly shaped cavity or opening (in axially proximal surface of opening 88) in the distal end of the handle 20 to ensure a uniquely matched interlock between the snake segment and the handle.

A further detent can be provided at the distally lower surface of projection 62 to engage with a corresponding receiving indentation in the radially outer portion of opening 88 in the handle, in order to ensure a snap fit or other secure attachment.

Contact surface 66 at the distal end of the snake segment mates with corresponding contact surface 90 at the distal end of handle 20, when the snake segment and handle are fully engaged. Similarly, when engaged, axial stop surface 64 at the end of the snake segment mates with the corresponding handle stop surface 84. Furthermore, any tab feature, as shown projecting from surface 90 of the distal end of the handle, can be provided to mate with a corresponding opening in the proximal end of the snake segment 50.

However, it is noted that the combination of the projection 62 and corresponding opening 88, as well as other notch-opening relationships between the proximal end of the snake segment and the distal end of the handle are exemplary of mating relationships that can vary in size and shape. It is most important that the mating contours of the proximal end of the snake segment and the corresponding distal end of the handle match in a manner that ensures the adequate transmission of the torque produced by rotating the handle crank (28, FIG. 4) to the distal end of the snake segment without loosening or disengaging the two interlocked ends during use. It is also important that different reusable handles be provided with unique mating contours at the interlocking end section to match snake segments that are uniquely matched to mate and interlock with the reusable handle.

The particular contour of the matching shaped projection of the snake segment and shaped opening of the handle, ensure that a unique snake segment can be uniquely engaged with a correspondingly unique handle.

FIG. 4 shows the inventive snake drain device in its disengaged configuration, with the sleeve 30 moved to the RELEASE POSITION, and with the end 54 of the snake segment 50 fully detached and disengaged from the corresponding end of the handle 20. The handle grip section 28 is shown integrally attached to the intermediate section 24 at an oblique angle.

A kit containing a set of differently shaped snake segments, each with a correspondingly matched handle, can be used, so long as the interlocking ends are suitably matched and the cranking of the handle can cause the rotation of snake segment to remove debris from piping structures. Different kits can contain snake segments that are matched to one unique handle, or to more than one handle in different kits. The snake segments in any individual kit have interlocking portions with proximal contours that match the corresponding contours of the interlocking portions of the handles in the individual kits.

The snake segment, handle and sleeve can be manufactured from plastic, metal, wood, or from a composite or any other suitable material that provides adequate strength to allow the device to be operated to remove obstructing debris from a pipe or duct.

The size of the drain snake device and the lengths of the snake segments can be provided in varying discrete amounts to allow use in correspondingly differently sized piping, drains or conduits. Longer snake segments, such as 6-9 feet (2-9 m) could be used to reach obstructions that are deeper; while shorter segments, such as 1-3 feet (30 cm-1 m) could be used to reach nearby obstructions, e.g., those in common toilet drains. The thickness of the snake segment 50 can range from 1 mm to 1 cm or higher to correspond to drain pipe sizes and types of debris being removed.

The snake segments are preferably disposable and can be made of any suitable disposable, recyclable or biodegradable material, such as polyethylene, polystyrene, polycarbonate, acrylic polymer, nylon, or a paper-based material, such as stiff cardboard. The handle is preferably reusable and can be made of a suitably durable material to withstand repeated engagement and disengagement with snake segments and repeated use.

We claim:

1. A drain snake device for removing obstructing debris from piping structures, comprising:

a. a reusable handle having:

a proximal elongated grip section for gripping the handle, an elongated intermediate section integrally extending from the grip section at an oblique angle, the proximal section forming a bend portion with the intermediate section; and, an elongated distal section, the distal section including a contoured interlockable distal end, the distal end having at least one stop surface defining part of a contour profile;

b. a disposable snake segment having an elongated distal section for contacting and collecting obstructing debris in the piping structure, the snake segment including a contoured interlockable proximal end, the proximal end having at least one projection having a shape generally complementary to the contour profile in the distal end of the handle and at least one stop surface having a shape profile generally complementary to the at least one corresponding stop surface in the distal end of the handle, defining a matching contour profile; and, c. a cylindrically shaped sleeve having a distal and a proximal end, and a notch in the proximal end, the sleeve being rotatably mounted on the distal section of the handle and the sleeve being movable along and coaxially with the distal section of the handle between a locked position and a release position;

wherein, the contoured distal end of the handle is engagable with and interlockable with the corresponding contour profile at the proximal end of the snake segment, such that the notch has a shape that corresponds to the shape of the bend portion between the intermediate section and the distal section of the handle, and, such that, when the sleeve is in the release position, the notch engages the bend portion of the handle, thereby blocking the handle from rotation, and, alternatively, when the sleeve is in the locked position, the notch is disengaged from the bend portion and the handle can be rotated by a user, and, such that, after the handle engages a corresponding snake segment, the sleeve can be moved to the locking position to interlock the handle to the snake segment; and, alternatively, the sleeve can be moved to the release position, to permit the snake segment to engage with or be disengaged from the handle, and, wherein, when the handle is engaged with the snake segment and the sleeve is in the locked position, the handle can be rotated, thereby rotating the snake segment.

2. A drain snake device for removing obstructing debris from piping structures, comprising:

a. a reusable handle having:

a proximal elongated grip section for gripping the handle, an elongated intermediate section integrally extending from the grip section at an oblique angle, the proximal section forming a bend portion with the intermediate section; and, an elongated distal section, the distal section including a contoured interlockable distal end, the distal end having at least one opening and at least one stop surface defining a contour profile;

b. a disposable snake segment having an elongated distal section for contacting and collecting obstructing debris in the piping structure, the snake segment including a contoured interlockable proximal end, the proximal end having at least one projection having a shape generally complementary to the at least one opening in the distal end of the handle and at least one stop surface having a shape profile generally complementary to the at least one corresponding stop surface in the distal end of the handle, defining a matching contour profile; and, c. a cylindrically shaped sleeve having a distal and a proximal end, and a notch in the proximal end, the sleeve being rotatably mounted on the distal section of the handle and the sleeve being movable along and coaxially with the distal section of the handle between a locked position and a release position;

wherein, the contoured distal end of the handle is engagable with and interlockable with the corresponding contour profile at the proximal end of the snake segment, such that the notch has a shape that corresponds to the shape of the bend portion between the intermediate section and the distal section of the handle, and, such that, when the sleeve is in the release position, the notch engages the bend portion of the handle, thereby blocking the handle from rotation, and, alternatively, when the sleeve is in the locked position, the notch is disengaged from the bend portion and the handle can be rotated by a user, and, such that, after the handle engages a corresponding snake segment, the sleeve can be moved to the locking position to interlock the handle to the snake segment; and, alternatively, the sleeve can be moved to the release position, to permit the snake segment to engage with or be disengaged from the handle, and, wherein, when the handle is engaged with the snake segment and the sleeve is in the locked position, the handle can be rotated, thereby rotating the snake segment.

3. A drain snake kit comprising a drain snake device as recited in claim 2, further comprising:

a plurality of snake segments, having at least two snake segments with different lengths, that have proximal ends having contoured profiles matching the contoured profile of the distal end of the handle.

* * * * *